US006479452B2

(12) United States Patent
Weuthen et al.

(10) Patent No.: US 6,479,452 B2
(45) Date of Patent: Nov. 12, 2002

(54) SURFACTANT GRANULES WITH AN IMPROVED DISSOLVING RATE COMPRISING ALKY AND ALKENYL SULFATES

(75) Inventors: Manfred Weuthen, Langenfeld; Ditmar Kischkel, Monheim, both of (DE)

(73) Assignee: Cognis Deutschland GmbH & Co. KG, Dusseldorf (DE)

( * ) Notice: Subject to any disclaimer, the term of this patent is extended or adjusted under 35 U.S.C. 154(b) by 0 days.

(21) Appl. No.: 09/896,308

(22) Filed: Jun. 29, 2001

(65) Prior Publication Data

US 2002/0111286 A1 Aug. 15, 2002

(30) Foreign Application Priority Data

Jun. 29, 2000 (DE) ..... 100 316 19

(51) Int. Cl.[7] ..... C11D 17/00

(52) U.S. Cl. ..... 510/357; 510/424; 510/426; 510/446; 510/447; 510/492; 134/40

(58) Field of Search ..... 510/357, 424, 510/426, 446, 447, 492; 134/40

(56) References Cited

U.S. PATENT DOCUMENTS

| | | | | |
|---|---|---|---|---|
| 3,966,629 A | | 6/1976 | Dumbrell | |
| 4,062,647 A | | 12/1977 | Storm et al. | |
| 4,664,839 A | | 5/1987 | Hans-PeterRieck | |
| 4,737,306 A | | 4/1988 | Wichelhaus et al. | |
| 4,816,553 A | | 3/1989 | Baur et al. | |
| 5,318,733 A | | 6/1994 | Carduck et al. | |
| 5,356,607 A | | 10/1994 | Just | |
| 5,580,941 A | | 12/1996 | Krause et al. | |
| 5,668,100 A | * | 9/1997 | Schmid et al. | 510/446 |
| 5,830,956 A | | 11/1998 | Stockhausen et al. | |
| 5,866,531 A | * | 2/1999 | Assmann et al. | 510/446 |

FOREIGN PATENT DOCUMENTS

| | | |
|---|---|---|
| DE | 2 334 899 | 1/1974 |
| DE | 35 26 405 | 2/1987 |
| DE | 38 16 842 | 11/1989 |
| DE | 42 21 381 | 2/1994 |
| DE | 43 00 772 | 3/1997 |
| EP | 0 026 529 | 4/1981 |
| EP | 0 028 432 | 1/1984 |
| EP | 0 164 514 | 6/1989 |
| EP | 0 280 223 | 10/1991 |
| EP | 0 486 592 | 6/1994 |
| GB | 1400898 | 7/1975 |
| WO | WO91/08171 | 6/1991 |
| WO | WO93/02176 | 2/1993 |
| WO | WO94/09111 | 4/1994 |
| WO | WO98/12299 | 3/1998 |

* cited by examiner

*Primary Examiner*—Necholus Ogden
(74) *Attorney, Agent, or Firm*—John E. Drach; Steven J. Trzaska

(57) ABSTRACT

A surfactant composition containing: (a) from about 75 to 97% by weight of an alkyl sulfate; and (b) from about 3 to 25% by weight of an alkenyl sulfate, all weights being based on the weight of the composition, and wherein the surfactant composition is in granular form.

9 Claims, No Drawings

SURFACTANT GRANULES WITH AN IMPROVED DISSOLVING RATE COMPRISING ALKY AND ALKENYL SULFATES

BACKGROUND OF THE INVENTION

This invention relates generally to solid laundry detergents, dishwashing detergents and cleaning compositions and, more particularly, to new surfactant granules distinguished by improved solubility in cold water, to a process for their production and to their use.

PRIOR ART

Nowadays, surfactants are preferably used in granular, substantially water-free form for the production of solid laundry detergents, dishwashing detergents and cleaning compositions. Various processes have been found to be suitable for the production of granular surfactants. However, one feature common to all commercially available surfactant granules is that they have an unsatisfactory dissolving rate, particularly in cold water. For this reason, detergent tablets based on anionic or nonionic surfactants cannot be directly introduced into the dispensing compartment of washing machines despite the use of considerable quantities of disintegrating agents; instead, they have to be directly added to the wash liquor. Anionic surfactants are important ingredients of detergents/cleaners. Where they are to form part of powder-form cleaners of high bulk density or compacted detergents, for example detergent tablets, alkyl sulfates—also known as fatty alcohol sulfates (FAS)—are preferably used in powder or granular form. These FAS powders or granules are normally produced by spray drying or drying in a continuous fluidized bed. $C_{16/18}$ fatty alcohol sulfate granules in particular, which have been produced by drying and granulation in a continuous fluidized bed, show inadequate solubility and dispersibility at low temperatures. There is a risk of traces of detergent being left behind, particularly in the case of colored washing which has to be washed at low temperatures.

Since the solution to this problem is very important for cold washing and for the use of detergent compactates, the problem addressed by the present invention was to provide long-chain alkyl sulfate granules with improved dissolving and dispersing behavior at low temperatures and to improve the dissolving behavior of detergent compactates through the use of these granules.

DESCRIPTION OF THE INVENTION

The present invention relates to surfactant granules consisting of (a) 75 to 97% by weight of an alkyl sulfate, (b) 3 to 25% by weight of an alkenyl sulfate, with the proviso that the quantities add up to 100% by weight with water and optionally electrolyte salts, and to a process for the production of these surfactant granules.

The present invention also relates to the use of the surfactant granules according to the invention in laundry detergents, dishwashing detergents and cleaning compositions.

It has surprisingly been found that the preparations according to the invention dissolve spontaneously in water, even at low temperatures. Detergent compactates containing the granules according to the invention have a considerably shorter disintegration time and dissolving rate. Even the addition of small quantities of alkenyl sulfate leads to a distinctly better dissolving rate at low temperatures (temperatures of 25° C.±10° C.).

Alkyl sulfate granules produced in a continuous fluidized bed also show this improved dissolving behavior. The improved dissolving behavior also leads to improved disintegration of disintegrator-containing detergent tablets (cellulose-based disintegrator systems).

Alkyl Sulfates

Alkyl sulfates, which are often referred to as fatty alcohol sulfates and which form surfactant component (a), are the sulfation products of primary saturated alcohols which correspond to formula (I):

$$R^1O—SO_3X \quad (I)$$

where $R^1$ is a linear or branched, aliphatic alkyl group containing 6 to 22 and preferably 12 to 18 carbon atoms and X is an alkali metal and/or alkaline earth metal, ammonium, alkyl ammonium, alkanolammonium or glucammonium. Typical examples of alkyl sulfates which may be used for the purposes of the invention are the sulfation products of caproic alcohol, caprylic alcohol, capric alcohol, 2-ethyl hexyl alcohol, lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol and erucyl alcohol and the technical mixtures thereof obtained, for example, by the high-pressure hydrogenation of technical methyl ester fractions or aldehydes from Roelen's oxo synthesis. The sulfation products may advantageously be used in the form of their alkali metal salts, more particularly their sodium salts. Alkyl sulfate powders or needles based on $C_{16/18}$ tallow fatty alcohols or vegetable fatty alcohols of comparable C-chain distribution in the form of their sodium salts are particularly preferred.

Alkenyl Sulfates

Alkenyl sulfates, which are often referred to as ocenol sulfates, are understood to be the sulfation products of primary mono- and polyunsaturated alcohols which correspond to formula (II):

$$R^2O—SO_3X \quad (II)$$

in which $R^2$ is a linear or branched, mono- or polyunsaturated aliphatic alkenyl group containing 12 to 22 and preferably 16 to 18 carbon atoms and X is an alkali metal and/or alkaline earth metal, ammonium, alkyl ammonium, alkanolammonium or glucammonium. Alkenyl sulfates with an iodine value in the range from 5 to 60 and preferably in the range from 10 to 20 (palmocenol) or 50–55 (HD-ocenol), preferably based on $C_{16/18}$ alcohols, are particularly preferred.

Residual Moisture and Electrolyte Salts

The surfactant granules according to the invention have residual moisture contents of 0.5 to 7% by weight and preferably 0.5 to 1.5% by weight, depending on the production process, the drying conditions and the storage conditions The surfactant granules also contain free sodium hydroxide (0.2 to 1.2% by weight, preferably 0.4 to 0.8% by weight), free fatty alcohols (0.5 to 6% by weight, preferably 0.5 to 4% by weight) and varying amounts of electrolyte salts, for example sodium sulfate (0.2 to 10% by weight, preferably 0.5 to 5% by weight) and/or sodium chloride (0 to 2% by weight, preferably 0 to 0.5% by weight), from their production process.

Production Processes

The surfactant granules are produced by known processes, including SKET granulation, spray drying and droplet formation ("dropletization"). The granules may also be produced by compacting which includes press agglomeration, extrusion, roll compacting, pelleting and tabletting as operations.

Fluidized Bed Granulation

A particularly preferred process for the production of the surfactant granules according to the invention comprises subjecting the mixtures to fluidized bed granulation ("SKET" granulation). SKET fluidized bed granulation is understood to be a simultaneous granulation and drying process preferably carried out in batches or continuously. The mixtures of surfactants and disintegrating agents may be used both in dried form and in the form of a water-containing preparation. Preferred fluidized-bed arrangements have base plates measuring 0.4 to 5 m. The SKET granulation is preferably carried out at fluidizing air flow rates of 1 to 8 m/s. The granules are preferably discharged from the fluidized bed via a sizing stage. Sizing may be carried out, for example, by means of a sieve or by an air stream flowing in countercurrent (sizing air) which is controlled in such a way that only particles beyond a certain size are removed from the fluidized bed while smaller particles are retained in the fluidized bed. The inflowing air is normally made up of the heated or unheated sizing air and the heated bottom air. The temperature of the bottom air is between 80 and 400° C. and preferably between 90 and 350° C. A starting material, preferably surfactant granules from an earlier test batch, is advantageously introduced at the beginning of the granulation process.

Drying and Granulation in a Flash Dryer

The simultaneous drying and granulation process may also be carried out in a horizontally arranged thin-layer evaporator or dryer with rotating internals of the type marketed, for example, by the VRV company under the name of "Flashdryer" or by the VOMM company under the name of "Turbodryer". In simple terms, the flash dryer/turbodryer is a tube which can be heated to different temperatures over several zones. The paste-form starting material, which is introduced by a pump, is projected onto the heated wall by one or more shafts fitted with paddles or plowshares as rotating internals and is dried on the heated wall in a thin layer typically with a thickness of 1 to 10 mm. According to the invention, it has been found to be of advantage to apply a temperature gradient of 130° C. (product entrance) to 20□C. (product exit) to the thin layer evaporator. To this end, the first two zones of the evaporator for example may be heated to 120–130° C. and the last zone cooled to 20° C. The thin-layer evaporator/dryer is operated at atmospheric pressure, air, but preferably an alkaline gas stream, for example ammonia (throughput 50 to 150 $m^3$/h), being passed through in countercurrent (throughput about 50–150 $m^3$/h). The gas entry temperature is generally in the range from 20 to 30° C. while the exit temperature is in the range from 90 to 110° C. The throughput of the surfactant pastes is of course dependent on the size of the dryer and amounts, for example, to between 5 and 25 kg/h. It is advisable to heat the pastes to 40–60° C. during their introduction into the dryer and to add 0.05 to 0.5% by weight, based on the solids content, of alkali metal carbonate, preferably sodium carbonate, to them in order to avoid hydrolysis processes.

In another preferred embodiment of the process according to the invention, water-containing surfactant is mixed with already dried end product on the hot contact surface. To this end, a product stream of about 10 to 40% by weight and preferably 15 to 25% by weight, based on the volumetric flow rate of the paste used, is removed at the dryer exit and directly fed back into the apparatus in the immediate vicinity of the paste entry point by means of a solids metering screw. Through this measure, the tackiness of the water-containing surfactant can be reduced and better wall contact of the product over the entire available surface can be established. In this way, transport of the product is stabilized and drying of the product intensified. At the same time, the particle size distribution of the granules can be displaced as required towards coarser products, i.e. the unwanted fine dust content can be significantly reduced, by the addition of the end product. An increase in throughput, based on analogous process conditions with no recycling of solids, can be achieved by this measure.

In addition, after drying, it has proved to be of considerable advantage to transfer the granules, which are still at about 50 to 70° C., to a conveyor belt, preferably a vibrating chute or the like, and to cool them quickly, i.e. in 20 to 60 seconds, with ambient air to temperatures of about 30 to 40° C. In order further to improve their resistance to the unwanted absorption of water, the granules of particularly hygroscopic surfactants may also be subsequently dusted with 0.5 to 2% by weight of silica.

Other Processes

In another embodiment, the surfactant granules are produced by extrusion as described, for example in European patent EP 0 486 592 B1 or International patent applications WO 93/02176 and WO 94/09111 or WO 98/12299. In this extrusion process, a solid premix is extruded under pressure to form a strand and, after emerging from the multiple-bore extrusion die, the strands are cut into granules of predetermined size by means of a cutting unit. The solid, homogeneous premix contains a plasticizer and/or lubricant of which the effect is to soften the premix under the pressure applied or under the effect of specific energy, so that it can be extruded. Preferred plasticizers and/or lubricants are surfactants and/or polymers. Particulars of the actual extrusion process can be found in the above-cited patents and patent applications to which reference is hereby expressly made. In one preferred embodiment of the invention, the premix is delivered, preferably continuously, to a planetary roll extruder or to a twin-screw extruder with co-rotating or contra-rotating screws, of which the barrel and the extrusion/granulation head can be heated to the predetermined extrusion temperature. Under the shear effect of the extruder screws, the premix is compacted under a pressure of preferably at least 25 bar or—with extremely high throughputs—even lower, depending on the apparatus used, plasticized, extruded in the form of fine strands through the multiple-bore extrusion die in the extruder head and, finally, size-reduced by means of a rotating cutting blade, preferably into substantially spherical or cylindrical granules. The bore diameter of the multiple-bore extrusion die and the length to which the strands are cut are adapted to the selected granule size. In this embodiment, granules are produced in a substantially uniformly predeterminable particle size, the absolute particle sizes being adaptable to the particular application envisaged. In general, particle diameters of up to at most 0.8 cm are preferred. Important embodiments provide for the production of uniform granules in the millimeter range, for example in the range from 0.5 to 5 mm and more particularly in the range from about 0.8 to 3 mm. In one important embodiment, the length-to-diameter ratio of the primary granules is in the range from about 1:1 to about 3:1. In another preferred embodiment, the still plastic primary granules are subjected to another shaping process step in which edges present on the crude extrudate are rounded off so that, ultimately, spherical or substantially spherical extrudate granules can be obtained. If desired, small quantities of drying powder, for example zeolite powder, such as zeolite NaA powder, can be used in this step. This shaping step may be carried out in commercially available spheronizing machines. It is important in this regard to ensure that only small quantities of fines are formed in this stage. According to the present invention, drying—which is described as a preferred embodiment in the prior art documents cited above—may be carried out in a subsequent step but is not absolutely essential. It may even be preferred not to carry out drying after the compacting step. Alternatively, extrusion/compression steps may also be carried out in low-pressure extruders, in a Kahl press (manufacturer: Amandus Kahl) or in a so-called Bextruder (manufacturer: Bepex). In one particularly preferred embodiment of the invention, the temperature prevailing in the transition section of the screw, the pre-distributor and the extrusion die is controlled in such a way that the melting temperature of the binder or rather the upper limit to the melting range of the binder is at least reached and preferably exceeded. The temperature exposure time in the compression section of the extruder is preferably less than 2 minutes and, more particularly, between 30 seconds and 1 minute.

Another method for producing the surfactant granules, granulation and compacting, may be carried out in known manner. Where this method is used, it is possible in particular to compact the granules before, during or after granulation. From the applicational perspective, it has proved to be very favorable for the surfactant granules produced to have a particle size in the range from 0.01 to 6 mm and preferably in the range from 0.1 to 5 mm and, more particularly, for the percentage of granules outside the 0.1 to 5 mm range to make up less than 25% by weight.

The surfactant granules may be produced by roll compacting. In this variant, the premix is introduced between two rollers—either smooth or provided with depressions of defined shape—and rolled under pressure between the two rollers to form a sheet-like compactate. The rollers exert a high linear pressure on the premix and may be additionally heated or cooled as required. Where smooth rollers are used, smooth untextured compactate sheets are obtained. By contrast, where textured rollers are used, correspondingly textured compactates, in which for example certain shapes can be imposed in advance on the subsequent detergent particles, can be produced. The sheet-like compactate is then broken up into smaller pieces by a chopping and size-reducing process and can thus be processed to granules which can be further refined and, more particularly, converted into a substantially spherical shape by further surface treatment processes known per se. In roll compacting, too, the temperature of the pressing tools, i.e. the rollers, is preferably at most 150° C., more preferably at most 100° C. and most preferably at most 75° C. Particularly preferred production processes based on roll compacting are carried out at temperatures 10° C. and, in particular, at most 5° C. above the melting temperature of the binder or the upper temperature limit of the melting range of the binder. The temperature exposure time in the compression section of the rollers—either smooth or provided with depressions of defined shape—is preferably at most 2 minutes and, more particularly, between 30 seconds and 1 minute.

The surfactant granules may also be produced by pelleting. In this process, the premix is applied to a perforated surface and is forced through the perforations and at the same time plasticized by a pressure roller. In conventional pellet presses, the premix is compacted under pressure, plasticized, forced through a perforated surface in the form of fine strands by means of a rotating roller and, finally, is size-reduced to granules by a cutting unit. The pressure roller and the perforated die may assume many different forms. For example, flat perforated plates are used, as are concave or convex ring dies through which the material is pressed by one or more pressure rollers. In perforated-plate presses, the pressure rollers may also be conical in shape. In ring die presses, the dies and pressure rollers may rotate in the same direction or in opposite directions. A press suitable for carrying out the process according to the invention is described, for example, in DE 38 16 842 A1. The ring die press disclosed in this document consists of a rotating ring die permeated by pressure bores and at least one pressure roller operatively connected to the inner surface thereof which presses the material delivered to the die space through the pressure bores into a discharge unit. The ring die and pressure roller are designed to be driven in the same direction which reduces the shear load applied to the premix and hence the increase in temperature which it undergoes. However, the pelleting process may of course also be carried out with heatable or coolable rollers to enable the premix to be adjusted to a required temperature. In pelleting, too, the temperature of the pressing tools, i.e. the pressure rollers, is preferably at most 150° C., more preferably at most 100° C. and most preferably at most 75° C. Particularly preferred production processes based on pelleting are carried out at temperatures 10° C. and, in particular, at most 50° C. above the melting temperature of the binder or the upper temperature limit of the melting range of the binder.

One feature common to all the processes is that the premix is compacted and plasticized under pressure and that the individual particles are pressed against one another and adhere to one another with a commensurate reduction in porosity. In all the processes, the tools may be heated to relatively high temperatures or may be cooled to dissipate the heat generated by shear forces.

"Dropletization" is a process for the production of surfactant granules in which a stream of a water-containing surfactant preparation is converted into droplets ("dropletized") by passage through a vibrating casting plate and the droplets are exposed to a gaseous drying agent flowing in countercurrent which evaporates the water present and at the same time dries the granules.

The production of granules by dropletization using a vibrating casting plate is already known for the processing of synthetic waxes, resins and low-viscosity polyesters. Corresponding units are marketed, for example, by Rieter-Automatik under the name of "Droppo Line" for use in the textile industry. Casting plates in the form of perforated disks are preferably used, the droplets passing through the bores into the spray drying tower. These perforated disks preferably have an output of 100 to 800 kg/h and more particularly of the order of 500 kg/h, the diameter of the bores being between 0.5 mm (mean granule diameter 0.8 mm) and 1.4 mm (mean granule diameter 2.5 mm). The vibration frequency imposed on the water-containing surfactant preparations is typically in the range from 100 to 1,000 Hz and preferably in the range from 500 to 800 Hz. Compared with conventional processes, only a light excess pressure (typically 10 to 100 mbar) is applied. Drying in the spray drying tower may be carried out with hot air or hot combustion gases flowing in countercurrent at temperatures of, for example, 100 to 150° C., as adequately described in the prior art. The granules are substantially spherical and have mean diameters of 1 to 2.5 mm, depending on the bore diameter of the perforated plate and the vibration frequency. The dust content, i.e. particles smaller than 0.5 mm in size, is substantially zero.

Commercial Applications

The surfactant granules according to the invention contain (a) 75 to 97% by weight, preferably 85 to 95% by weight of an alkyl sulfate and (b) 3 to 25% by weight and preferably 5 to 15% by weight of an alkenyl sulfate, with the proviso that the quantities shown add up to 100% by weight with water and optionally electrolyte salts.

The present invention also relates to the use of the surfactant granules for the production of solid laundry detergents, dishwashing detergents and cleaning compositions in which they may be present in quantities of 1 to 90% by weight, preferably 5 to 50% by weight and more particularly 10 to 25% by weight, based on the detergent/cleaner. The detergents/cleaners may be present in the form of powders, granules, extrudates, agglomerates and, in particular, tablets and may contain other typical ingredients.

They are preferably used for the production of detergent compactates because it is precisely in their case that dissolving rate is such a critical factor.

Auxiliaries and Additives

Besides the ingredients mentioned above, the detergent compactates may contain other typical ingredients such as, for example, builders, bleaching agents, bleach activators, detergency boosters, enzymes, enzyme stabilizers, redeposition inhibitors, optical brighteners, soil repellents, foam inhibitors, inorganic salts, dyes and perfumes.

A suitable solid builder is, in particular, finely crystalline zeolite containing synthetic and bound water, such as detergent-quality zeolite NaA. However, zeolite NaX and mixtures of NaA and NaX are also suitable. The zeolite may be used in the form of a spray-dried powder or even as an undried stabilized suspension still moist from its production. Where the zeolite is used in the form of a suspension, the suspension may contain small additions of nonionic surfactants as stabilizers, for example 1 to 3% by weight—based on zeolite—of ethoxylated $C_{12-18}$ fatty alcohols containing 2 to 5 ethylene oxide groups or ethoxylated isotridecanols. Suitable zeolites have a mean particle size of less than 10 $\mu$m (volume distribution, as measured by the Coulter Counter Method) and contain preferably 18 to 22% by weight and more preferably 20 to 22% by weight of bound water. Suitable substitutes or partial substitutes for zeolites are crystalline layer-form sodium silicates with the general formula $NaMSi_xO_{2x+1}.yH_2O$, where M is sodium or hydrogen, x is a number of 1.9 to 4 and y is a number of 0 to 20, preferred values for x being 2, 3 or 4. Crystalline layer silicates such as these are described, for example, in European patent application EP 0 164 514 A. Preferred crystalline layer silicates are those in which M in the general formula stands for sodium and x assumes the value 2 or 3. Both β- and γ-sodium disilicates $Na_2Si_2O_5.yH_2O$ are particularly preferred, β-sodium disilicate being obtainable for example by the process described in International patent application WO 91/08171. The powder form detergents according to the invention preferably contain 10 to 60% by weight of zeolite and/or crystalline layer silicates as solid builders, mixtures of zeolite and crystalline layer silicates in any ratio being particularly advantageous. In one particularly preferred embodiment, the detergents contain 20 to 50% by weight of zeolite and/or crystalline layer silicates. Particularly preferred detergents contain up to 40% by weight of zeolite and, more particularly, up to 35% by weight of zeolite, based on water-free active substance. Other suitable ingredients of the detergents are water-soluble amorphous silicates which are preferably used in combination with zeolite and/or crystalline layer silicates. Particularly preferred detergents are those which contain above all sodium silicate with a molar ratio of $Na_2O$ to $SiO_2$ (modulus) of 1:1 to 1:4.5 and preferably 1:2 to 1:3.5. The amorphous sodium silicate content of the detergents is preferably up to 15% by weight and more preferably from 2 to 8% by weight. Phosphates, such as tripolyphosphates, pyrophosphates and orthophosphates, may also be present in the detergents in small quantities. The phosphate content of the detergents is preferably up to 15% by weight and, more particularly, from 0 to 10% by weight. In addition, the detergents may contain layer silicates of natural and synthetic origin. Corresponding layer silicates are known, for example, from patent applications DE 23 34 899 B, EP 0 026 529 A and DE 35 26 405 A. Their suitability for use is not confined to a particular composition or structural formula. However, smectites are preferred, bentonites being particularly preferred. Suitable layer silicates which belong to the group of water-swellable smectites are, for example, those corresponding to the following general formulae:

| | |
|---|---|
| $(OH)_4Si_{8-y}Al_y(Mg_xAl_{4-x})O_{20}$ | montmorillonite |
| $(OH)_4Si_{8-y}Al_y(Mg_{6-z}Li_z)O_{20}$ | hectorite |
| $(OH)_4Si_{8-y}Al_y(Mg_{6-z}Al_z)O_{20}$ | saponite |

where x=0 to 4, y=0 to 2 and z=0 to 6. In addition, small quantities of iron may be incorporated in the crystal lattice of the layer silicates corresponding to the above formulae. By virtue of their ion-exchanging properties, the layer silicates may also contain hydrogen, alkali metal and alkaline earth metal ions, more particularly $Na^+$ and $Ca^{2+}$. The quantity of water of hydration is generally in the range from 8 to 20% by weight and is dependent upon the degree of swelling and upon the processing method. Suitable layer silicates are known, for example, from U.S. Pat. Nos. 3,966,629, 4,062,647, EP 0 026 529 A and EP 0 028 432 A. Layer silicates which have been substantially freed from calcium ions and strongly coloring iron ions by an alkali treatment are preferably used. Useful organic builders are, for example, the polycarboxylic acids preferably used in the form of their sodium salts, such as citric acid, adipic acidic acid, succinic acid, glutaric acid, tartaric acid, sugar acids, aminocarboxylic acids, nitrilotriacetic acid (NTA), providing their use is not ecologically unsafe, and mixtures thereof. Preferred salts are the salts of polycarboxylic acids, such as citric acid, adipic acid, succinic acid, glutaric acid, tartaric acid, sugar acids and mixtures thereof. Suitable polymeric polycarboxylates are, for example, the sodium salts of polyacrylic acid or polymethacrylic acid, for example those with a relative molecular weight of 800 to 150,000 (based on acid). Suitable copolymeric polycarboxylates are, in particular, those of acrylic acid with methacrylic acid and acrylic acid or methacrylic acid with maleic acid. Copolymers of acrylic acid with maleic acid which contain 50 to 90% by weight of acrylic acid and 50 to 10% by weight of maleic acid are particularly suitable. Their relative molecular weight, based on free acids, is generally in the range from 5,000 to 200,000, preferably in the range from 10,000 to 120,000 and more preferably in the range from 50,000 to 100,000. It is not absolutely essential to use polymeric polycarboxylates. However, if polymeric polycarboxylates are used, detergents containing biodegradable polymers, for example terpolymers which contain acrylic acid and maleic acid or salts thereof and vinyl alcohol or vinyl alcohol derivatives as monomers or acrylic acid and 2-alkyl allyl sulfonic acid or salts thereof and sugar derivatives as monomers are preferred. The terpolymers obtained in accordance with the teaching of German patent applications DE 42 21 381 A and DE 43 00 772 A are particularly preferred. Other suitable builders are polyacetals which may be obtained by reacting dialdehydes with polyol carboxylic acids containing 5 to 7 carbon atoms and at least 3 hydroxyl groups, for example as described in European patent application EP 0 280 223 A. Preferred polyacetals are obtained from dialdehydes, such as glyoxal, glutaraldehyde, terephthalaldehyde and mixtures thereof and from polyol carboxylic acids, such as gluconic acid and/or glucoheptonic acid.

Among the compounds yielding hydrogen peroxide in water which are used as bleaching agents, sodium perborate tetrahydrate and sodium perborate monohydrate are particularly important. Other suitable bleaching agents are, for example, peroxycarbonate, citrate perhydrates and salts of peracids, such as perbenzoates, peroxyphthalates or diperoxydodecane-dioic acid. They are normally used in quantities of 8 to 25% by weight. Sodium perborate monohydrate is preferred and is used in quantities of 10 to 20% by weight and preferably in quantities of 10 to 15% by weight. By virtue of its ability to bind free water to form the tetrahydrate, it contributes towards increasing the stability of the detergent.

In order to obtain an improved bleaching effect where washing is carried out at temperatures of 60° C. or lower, bleach activators may be incorporated in the preparations. Examples of bleach activators are N-acyl and O-acyl compounds which form organic peracids with hydrogen peroxide, preferably N,N'-tetraacylated diamines, also carboxylic anhydrides and esters of polyols, such as glucose pentaacetate. The bleach activator content of bleach-containing detergents is in the usual range, i.e. preferably between 1 and 10% by weight and more preferably between 3 and 8% by weight. Particularly preferred bleach activators are N, N,N',N'-tetraacetyl ethylenediamine and 1,5-diacetyl-2,4-dioxohexahydro-1,3,5-triazine.

Suitable enzymes are those from the class of proteases, lipases, amylases, cellulases and mixtures thereof. Enzymes obtained from bacterial strains or fungi, such as *Bacillus subtilis, Bacillus licheniformis* and *Streptomyces griseus*, are particularly suitable. Proteases of the subtilisin type are preferably used, proteases obtained from *Bacillus lentuis* being particularly preferred. They may be used in quantities of about 0.2 to about 2% by weight. The enzymes may be adsorbed onto supports and/or encapsulated in membrane materials to protect them against premature decomposition. In addition to the monohydric and polyhydric alcohols and the phosphonates, the detergents may contain other enzyme stabilizers. For example, 0.5 to 1% by weight of sodium formate may be used. It is also possible to use proteases which are stabilized with soluble calcium salts and which have a calcium content of preferably about 1.2% by weight, based on the enzyme. However, it is of particular advantage to use boron compounds, for example boric acid, boron oxide, borax and other alkali metal borates, such as the salts of orthoboric acid ($H_3BO_3$), metaboric acid ($HBO_2$) and pyroboric acid (tetraboric acid $H_2B_4O_7$).

The function of redeposition inhibitors is to keep the soil detached from the fibers suspended in the wash liquor and thus to prevent discoloration. Suitable redeposition inhibitors are water-soluble, generally organic colloids, for example the water-soluble salts of polymeric carboxylic acids, glue, gelatin, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose, methyl cellulose, hydroxyalkyl cellulose, and mixed ethers, such as methyl hydroxyethyl cellulose, methyl hydroxypropyl cellulose, methyl carboxymethyl cellulose and mixtures thereof, and polyvinyl pyrrolidone are preferably used, for example in quantities of 0.1 to 5% by weight, based on the detergent.

The detergents may contain derivatives of diaminostilbene disulfonic acid or alkali metal salts thereof as optical brighteners. Suitable optical brighteners are, for example, salts of 4,4'-bis-(2-anilino-4-morpholino-1,3,5-triazinyl-6-amino)-stilbene-2,2'-disulfonic acid or compounds of similar structure which, instead of the morpholino group, contain a diethanolamino group, a methylamino group, an anilino group or a 2-methoxyethylamino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)-4'-(2-sulfostyryl)-diphenyl, may also be present. Mixtures of the brighteners mentioned above may also be used. Uniformly white granules are obtained if, in addition to the usual brighteners in the usual quantities, for example between 0.1 and 0.5% by weight and preferably between 0.1 and 0.3% by weight, the detergents also contain small quantities, for example $10^{-6}$ to $10^{-3}$% by weight and preferably around $10^{-5}$% by weight, of a blue dye. A particularly preferred dye is Tinolux® (a product of Ciba-Geigy).

Suitable soil repellents are substances which preferably contain ethylene terephthalate and/or polyethylene glycol terephthalate groups, the molar ratio of ethylene terephthalate to polyethylene glycol terephthalate being in the range from 50:50 to 90:10. The molecular weight of the linking polyethylene glycol units is more particularly in the range from 750 to 5,000, i.e. the degree of ethoxylation of the polymers containing poly-ethylene glycol groups may be about 15 to 100. The polymers are distinguished by an average molecular weight of about 5,000 to 200,000 and may have a block structure, but preferably have a random structure. Preferred polymers are those with molar ethylene terephthalate: polyethylene glycol terephthalate ratios of about 65:35 to about 90:10 and preferably in the range from about 70:30 to 80:20. Other preferred polymers are those which contain linking polyethylene glycol units with a molecular weight of 750 to 5,000 and preferably in the range from 1,000 to about 3,000 and which have a molecular weight of the polymer of about 10,000 to about 50,000. Examples of commercially available polymers are the products Milease® T (ICI) or Repelotex® SRP 3 (Rhône-Poulenc).

Where the detergents are used in washing machines, it can be of advantage to add typical foam inhibitors to them. Suitable foam inhibitors are, for example, soaps of natural or synthetic origin which have a high percentage content of $C_{18-24}$ fatty acids. Suitable non-surface-active foam inhibitors are, for example, organopolysiloxanes and mixtures thereof with microfine, optionally silanized, silica and also paraffins, waxes, microcrystalline waxes and mixtures thereof with silanized silica or bis-stearyl ethylenediamide. Mixtures of different foam inhibitors, for example mixtures of silicones, paraffins and waxes, may also be used with advantage. The foam inhibitors, more particularly siliconeand/or paraffin-containing foam inhibitors, are preferably fixed to a granular water-soluble or water-dispersible support. Mixtures of paraffins and bis-stearyl ethylenediamides are particularly preferred.

EXAMPLES

Performance Test

A quantity of granules corresponding to 10 g of surfactant was introduced into 1 liter of water (25° C.) with continuous stirring. The solution was filtered through a sieve (mesh width: 0.2 mm) after 30 s (T1), 60 s (T2) and 180 s (T3). The filter residue was briefly washed with acetone, dried and then weighed. The results are set out in Table 1.

TABLE 1

Example illustrating the improvement in solubility of the raw material (quantities in % by weight)

| Composition | | | | | | |
|---|---|---|---|---|---|---|
| $C_{16/18}$ alkyl sulfate | 100 | 95 | 90 | 85 | 8-0 | 75 |
| $C_{16/18}$ alkenyl sulfate* | 0 | 5 | 10 | 15 | 20 | 25 |
| Solubility in the hand washing test (% residue) at 25° C. | 50.6 | 32.4 | 32.2 | 28 | 22.3 | 12.4 |

*Ocenol sulfate (based on HD Ocenol ® 50/55)

To evaluate other performance properties, the surfactant granules according to the invention were used in detergent tablets (formulations F-1 to F3). These detergent tablets were compared for dissolving rate with two examples of conventional detergent tablets (C1 and C2). The preparations were tabletted (tablet weight 40 g, constant fracture hardness), hermetically packed and then stored for 2 weeks at 40° C. The composition of the detergent tablets is shown in Table 2. Formulations 1, 2 and 3 correspond to the invention, formulations C1 and C2 are intended for comparison. To evaluate dissolving behavior, the tablets were placed on a wire frame standing in water (0° d, 25C.). The tablets were completely immersed in the water. The disintegration time from immersion to complete dissolution was measured. The disintegration times are also shown in Table 2.

TABLE 2

Example illustrating the solubility of a detergent tablet (quantities in % by weight)

| Composition | F1 | F2 | F3 | C1 | C2 |
|---|---|---|---|---|---|
| Granules according to the invention* | 15 | 10 | 15 | | |
| Coconut alcohol sulfate Na** | | | | 15 | 15 |
| $C_{12/14}$ alkyl polyglucoside*** | | 5 | | | |
| $C_{12/18}$ coconut fatty alcohol + 7 EO | 1 | 1 | 1 | 1 | 1 |
| Sodium silicate | 2 | 2 | 2 | 2 | 2 |
| Sodium percarbonate | 12 | 12 | 12 | 12 | 12 |
| Disintegrator Arbocel G350 | 15 | 15 | 15 | 15 | 15 |
| Sodium tripolyphosphate | | | 29 | | 29 |
| Zeolite A | 25 | 25 | | 25 | 25 |
| Polycarboxylate**** | 4 | 4 | | 4 | |
| TAED | 4 | 4 | 4 | 4 | 4 |
| Foam inhibitor | 5 | 5 | 5 | 5 | 5 |
| Sodium carbonate | 7 | 7 | 7 | 7 | 7 |

TABLE 2-continued

Example illustrating the solubility of a detergent tablet (quantities in % by weight)

| Composition | F1 | F2 | F3 | C1 | C2 |
|---|---|---|---|---|---|
| Water (residual moisture) | to 100 | to 100 | to 100 | to 100 | to 100 |
| Dissolving rate (disintegration) [s] | 55 | 35 | 40 | 120 | 100 |

*Granules containing 95% by weight anionic surfactant consisting of 75% by weight $C_{16/18}$ saturated fatty alcohol sulfate and 25% by weight alkenyl sulfate (based on HD Ocenol ® 50/55)
**contains 95% by weight anionic surfactant (Sulfopon ® 1218 G)
***contains 50% by weight nonionic surfactant (Glucopon ® 50 G)
****Sokalan ® CP5

What is claimed is:

1. A surfactant composition comprising:

(a) from about 75 to 97% by weight of an alkyl sulfate; and (b) from about 3 to 25% by weight of an alkenyl sulfate, all weights being based on the weight of the composition, and wherein the surfactant composition is in granular form.

2. The composition of claim 1 wherein the surfactant composition has a residual moisture content of from about 0.5 to 7% by weight, based on the weight of the composition.

3. The composition of claim 1 wherein the alkyl sulfate corresponds to formula I:

$$R^1O—SO_3X \quad (I)$$

wherein $R^1$ is a linear or branched, aliphatic alkyl group containing from about 6 to 22 carbon atoms and X is an alkali metal, alkaline earth metal, ammonium, alkyl ammonium, alkanolammonium or glucammonium.

4. The composition of claim 1 wherein the alkenyl sulfate corresponds to formula II:

$$R^2O—SO_3X \quad (II)$$

wherein $R^2$ is a linear or branched, mono- or polyunsaturated aliphatic alkenyl group containing from about 12 to 22 carbon atoms and X is an alkali metal, alkaline earth petal, ammonium, alkyl ammonium, alkanolammonium or glucammonium.

5. The composition of claim 1 wherein the alkenyl sulfate has an iodine value of from about 5 to 60.

6. A tablet-form cleaning composition containing the surfactant composition of claim 1.

7. A process for both shortening disintegration time and enhancing dissolution rate of a tablet-form cleaning composition, in water, comprising adding the surfactant composition of claim 1 to a tablet-form cleaning composition.

8. A process for making surfactant granules capable of both shortening disintegration time and enhancing dissolution rate of a tablet-form cleaning composition, in water, the process comprising:

(a) providing an aqueous paste containing about 75 to 97% by weight of an alkyl sulfate; and (b) simultaneously drying and granulating the aqueous paste in the presence of about 3 to 25% by weight of an alkenyl sulfate, to form the surfactant granules.

9. The process of claim 8 wherein simultaneous drying and granulating is performed in a fluidized bed.

* * * * *